US006623478B1

(12) United States Patent
Hagiwara

(10) Patent No.: US 6,623,478 B1
(45) Date of Patent: Sep. 23, 2003

(54) SUCTION CUP FOR BODY FAT REDUCTION

(76) Inventor: Hidenori Hagiwara, 9-17, Ohoka 3-chome, Minami-ku, Yokohama-shi, Kanagawa-ken (JP)

( * ) Notice: Subject to any disclaimer, the term of this patent is extended or adjusted under 35 U.S.C. 154(b) by 13 days.

(21) Appl. No.: 09/595,290

(22) Filed: Jun. 15, 2000

(51) Int. Cl.[7] ..... A61H 9/00
(52) U.S. Cl. ..... 606/12; 606/7
(58) Field of Search ..... 601/12, 7, 10, 601/11, 46; 604/74, 315, 27; 73/149; 128/205.14, 205.19, 207.15

(56) References Cited

U.S. PATENT DOCUMENTS 67,663 A * 8/1867 Mattson
2,432,211 A * 12/1947 Rocke
5,454,778 A * 10/1995 Liaskos ..... 601/12

* cited by examiner

*Primary Examiner*—Jerome Donnelly
(74) *Attorney, Agent, or Firm*—Muserlian, Lucas and Mercanti

(57) ABSTRACT

A suction cup for body fat reduction which brings about an improved fat reduction effect. The suction cup for body fat reduction has a tube section 3 to be attached tightly at an open end to a part of the body where fat reduction is desired, and sucks in the part of the body as an inside area of the suction cup is decompressed. The tube section 3 is made of a deflectable material and provided with thin portions 27, 27 and 29, 29 at opposite sides. This structure allows at least the open end of the tube section 3 to deflect elastically into a flat shape and press the sucked-in part of the body from opposite sides when the inside area of the suction cup is decompressed.

6 Claims, 5 Drawing Sheets

FIG. 6
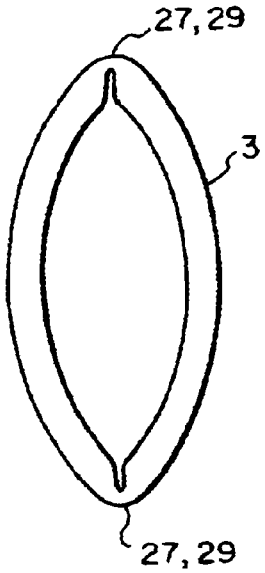
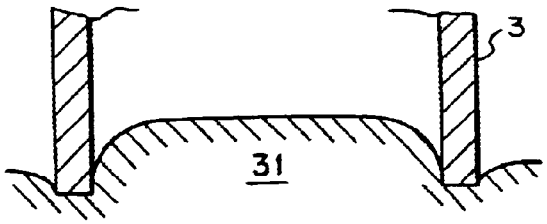
FIG. 7A
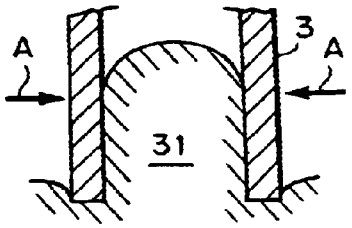
FIG. 7B

SUCTION CUP FOR BODY FAT REDUCTION

BACKGROUND OF THE INVENTION

1. Field of the Invention

The present invention relates to a suction cup for body fat reduction, for reducing subcutaneous fat at a part of the body where fat reduction is desired.

2. Description of the Related Art

Heretofore, there has been widely known suction therapy that removes blood congestion in an affected area by decompressing an inside area of a suction cup, known as a sucker or a suction ball, with an open end thereof tightly attached to the affected area so that the suction cup sucks in the affected area, wherein the decompression is carried out by using a vacuum pump etc. or bringing alcohol etc. to combustion inside the suction cup to reduce the air or oxygen within the cup.

A cosmetic body fat reduction method that employs the suction therapy and draws dissipation of unnecessary subcutaneous fat by letting the suction cup suck in a part of the body with excessive subcutaneous fat where fat reduction is desired, e.g. a belly part, has also been proposed.

A demand for a more substantial fat reduction effect always exists with any cosmetic body fat reduction method, and so it does with the body fat reduction method using the suction cup.

However, the fat reduction effects caused by existing suction cups are not substantial enough, because every existing suction cup is made of a glass material or a rigid plastic material and the part of the body where fat reduction is desired, the part of the body defined by the open end of the suction cup, is allowed to move only in an inward direction of the suction cup when the inside area of the suction cup is decompressed.

SUMMARY OF THE INVENTION

The object of the present invention is to provide a suction cup for body fat reduction which is expected to bring about a more substantial fat reduction effect than the existing suction cups as referred to above.

In order to attain the object, the suction cup of the present invention has a tube section to be attached tightly at an end portion thereof to the part of the body where fat reduction is desired and sucks in the part of the body as an inside area of the suction cup is decompressed, wherein the tube section is constructed so that at least the end portion of the tube section deflects elastically into a flat shape to press the sucked-in part of the body from opposite sides thereof as the inside area is decompressed.

In the present invention, it is possible to make the tube section out of a deflectable material and concurrently provide thin portions at opposite sides of the tube section.

In the present invention, it is also possible to construct the tube section so that at least the end portion of the tube section deflects elastically into a flat and winding shape as the inside area is decompressed to twist the sucked-in part of the body while pressing the same part from opposite sides thereof.

Further, it is possible to provide a connecting aperture section on the suction cup, which is capable of being fixed to and detached from vacuum means, and provide the aperture section with a non-return valve which prevents air-flow into the suction cup after the vacuum means is detached.

In the present invention, it is also possible to adopt other methods for decompressing the inside area of the suction cup than the method of using the vacuum means such as a vacuum pump. For example, the decompressing method of bringing alcohol etc. to combustion inside the suction cup to reduce the air or oxygen therein may be adopted.

According to the present invention, at least the end portion of the tube section of the suction cup deflects elastically into a flat shape to press the sucked-in part of the body where fat reduction is desired from opposite sides thereof as the inside area of the suction cup is decompressed. Thus, the subcutaneous fat at the part of the body is dissipated effectively and excellent fat reduction can be achieved, because the subcutaneous fat at the part of the body is not only sucked in but also pressed from opposite sides under the decompression.

In the case where the tube section is made of the deflectable material and the thin portions are provided at opposite sides of the tube section, the end portion of the tube section bends easily at the thin portions where the local strength of the tube section is lowered as the inside area of the tube section is decompressed, and deflects into a flat shape as a whole. This means that the elastic deflection of the tube section into the flat shape can be realized with a simple structure.

In the case where the end portion of the tube section is constructed so as to deflect elastically into a flat and winding shape to twist the part of the body being pressed from opposite sides thereof, a twisting force is applied to the part of the body in addition to a pressing force. Thus, it is expected that even more excellent fat reduction can be achieved.

In the case where the vacuum means is used for decompressing the inside area of the suction cup and the connecting aperture section connected with the vacuum means is provided with the non-return valve which prevents air-flow into the suction cup, the non-return valve closes to maintain the decompressed state inside the suction cup when the vacuum means is detached from the connecting aperture section. Thus, it is possible to allot one suction cup to each of multiple parts of the body where fat reduction is desired, and decompress the inside area of each cup one by one using single vacuum means by repeating fixing and detaching of the vacuum means for the aperture sections of all the suction cups.

BRIEF DESCRIPTION OF THE DRAWINGS

FIG. 6 is a cross-sectional view of a tube section deflecting elastically into a flat shape, FIGS. 7A and 7B are side views of a part of the body where fat reduction is desired being sucked into a tube section and pressed from opposite sides thereof.

DESCRIPTION OF THE PREFERRED EMBODIMENTS

The first embodiment of the present invention will now be described with reference to FIGS. 1 to 5 of the accompanying drawings.

Figure 1:
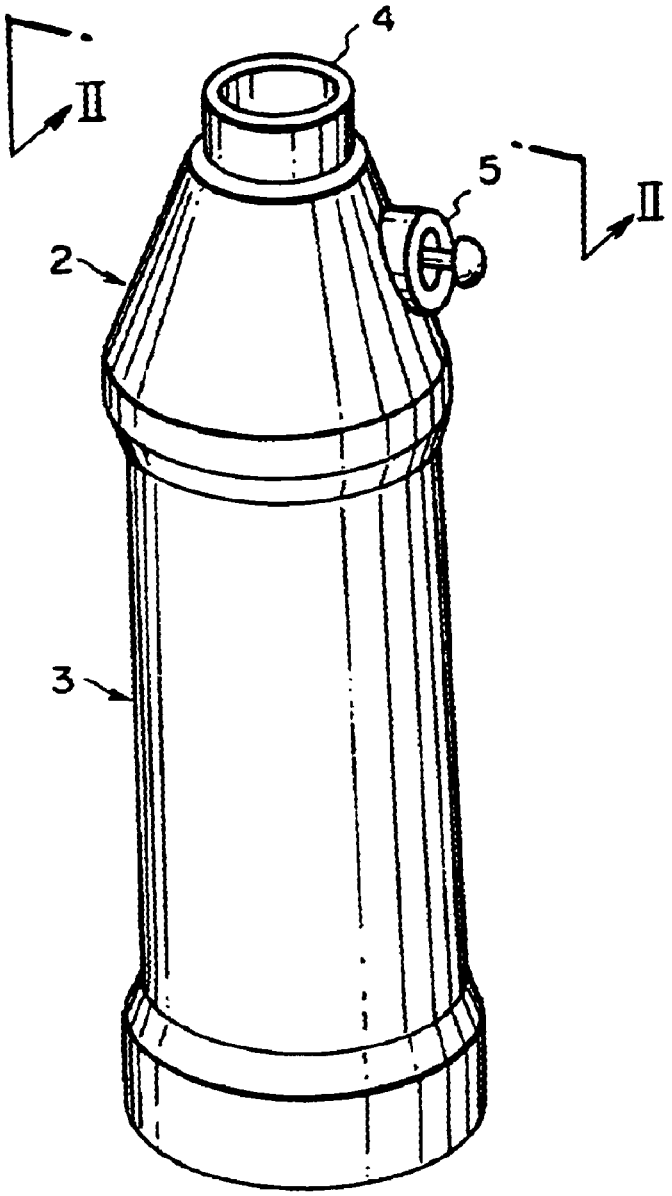
FIG. 1 is a perspective view of the suction cup for body fat reduction in accordance with the first embodiment of the present invention.

Referring to FIG. 1, the suction cup for body fat reduction is constituted of a cup body 2 and a tube section 3 connected thereto.

Figure 2:
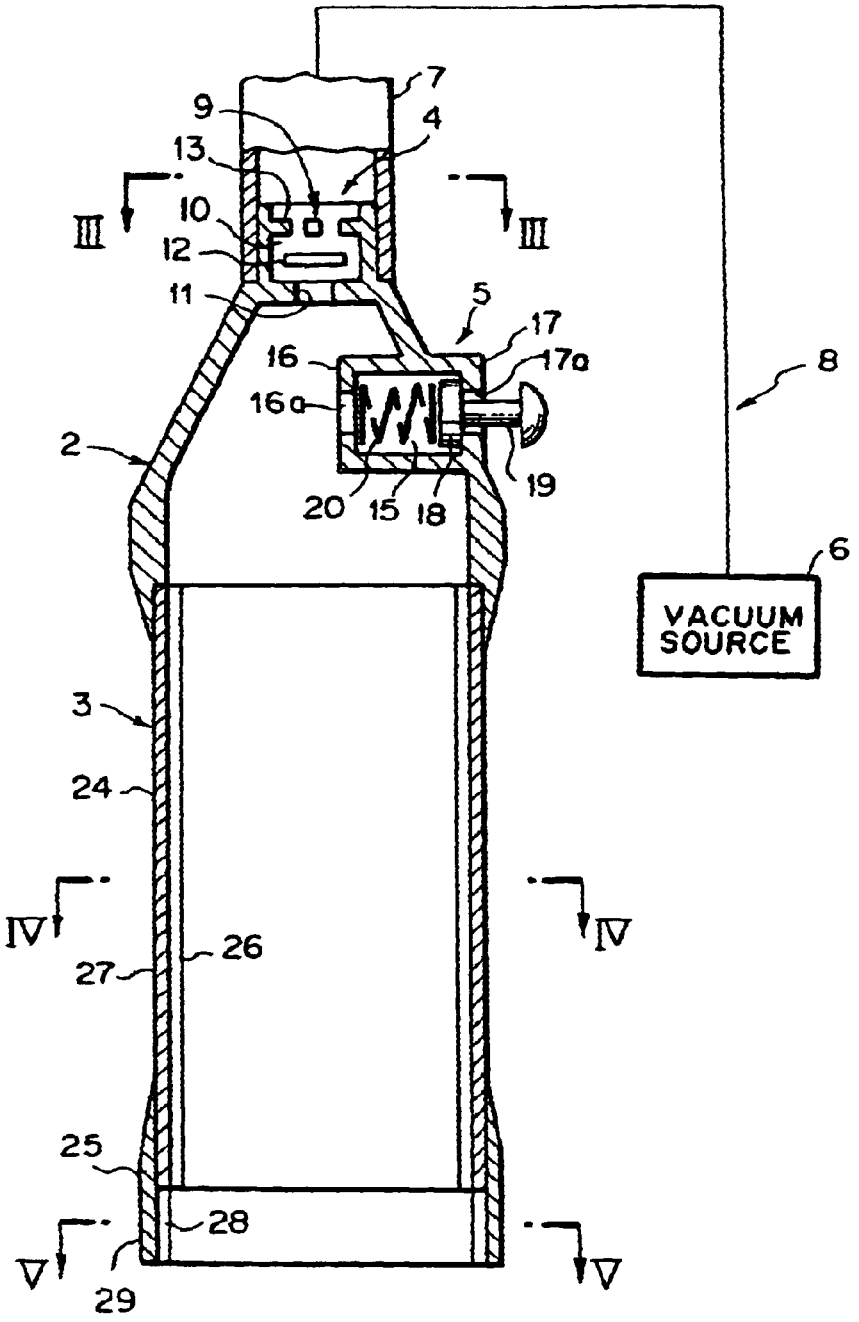
FIG. 2 is a cross-sectional view taken along the line II—II of FIG. 1.
Figure 3:
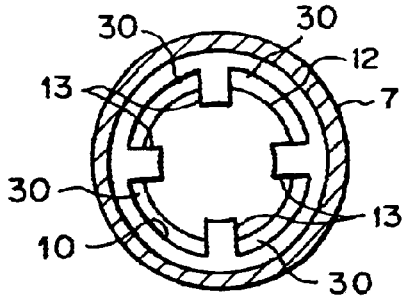
FIG. 3 is a cross-sectional view taken along the line SUCTION CUP FOR BODY FAT REDUCTION III—III of FIG. 2.

The cup body 2 is of a bell-like shape and made of a rigid plastic material such as rigid vinyl chloride resin. A connecting aperture section 4 is provided at the top of the cup body 2, and a suction release section 5 is provided on a side of the cup body 2. As shown in FIG. 2, a hose 7 is connected to a vacuum source 6, e.g. a vacuum pump, at one end and connected to the connecting aperture section 4 at the other end, wherein the hose 7 is capable of being fixed to and detached from the connecting aperture section 4 repeatedly and air inside the suction cup is drawn by the vacuum source 6 via the connecting aperture section 4. The vacuum source 6 and the hose 7 together constitute vacuum means 8. The connecting aperture section 4 is provided with a non-return valve 9, which allows air to flow out from the inside area of the cup to the outside via the connecting aperture section 4 but prevents inflow of air from the outside to the inside area. As shown in FIG. 3, the non-return valve 9 includes an air path 10 having an open top end and an aperture 11 which is opened on a bottom portion located at the top of the cup body 2, the diameter of the aperture 11 being smaller than the diameter of the air path 10, a valve member 12 which is located above the aperture 11, the diameter of the valve member 12 being larger than the diameter of the aperture 11 but smaller than the diameter of the air path 10, and stopper projections 13 which are provided above the valve member 12 for preventing upward movements of the valve member 12 by projecting inwardly from the inner surface of the air path 10.

The suction release section 5 includes an air path portion 15 interconnecting the inside area and the outside of the cup body 2, the air portion 15 having an inner end wall 16 with an inner end aperture 16*a* and an outer end wall 17 with an outer end aperture 17*a*, a valve member 18 which is provided within the air path portion 15 and has a diameter larger than a diameter of the outer end aperture 17*a* but smaller than a diameter of the air path portion 15, a handle portion 19 which has a diameter smaller than the diameter of the outer end aperture 17*a* and protrudes from the valve member 18 out to the outer side of the outer end wall 17 via the outer end aperture 17*a*, and a compression spring 20 which is provided within the air path portion 15 between the inner end wall 16 and the valve member 18 as urging means for urging the valve member 18 toward the outer end wall 17.

Figure 4:
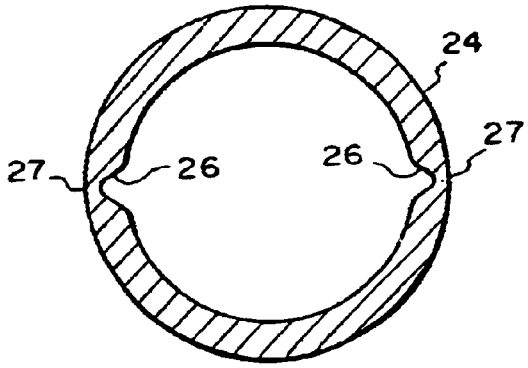
FIG. 4 is a cross-sectional view taken along the line IV—IV of FIG. 2.

The tube section 3 comprises a main tube section 24 and an attachment tube section 25. The main tube section 24 is constituted of a cylindrical member made of a deflectable material, e.g. a flexible plastic material such as flexible vinyl chloride resin, and an upper end of the main tube section 24 is fixed tightly to a lower open end of the cup body 2. An inner surface of the main tube section 24 is provided with grooves 26, 26 at opposite sides thereof as best shown in FIG. 4, wherein the grooves 26, 26 run along a top-bottom direction (along the axial direction of the tube section 3) to form thin portions 27, 27 along the top-bottom direction. Each of the grooves 26, 26 and also the thin portions 27, 27 covers the entire length of the main tube section 24 from the upper end to the lower end along the axial direction thereof.

Figure 5:
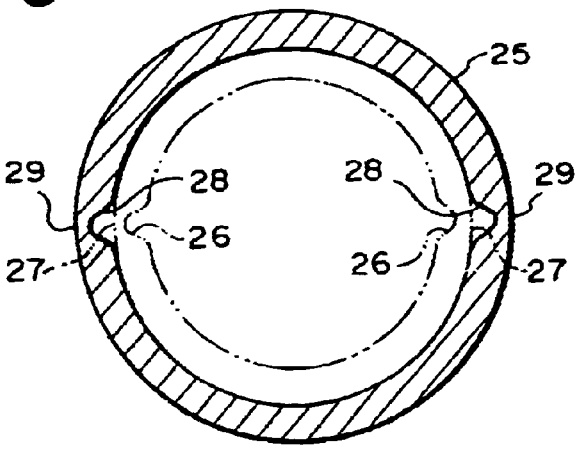
FIG. 5 is a cross-sectional view taken along the line V—V of FIG. 2.

The attachment tube section 25 is fixed tightly at an upper end thereof to the lower end of the main tube section 24 and constituted of a cylindrical member made of a deflectable material, e.g. a flexible plastic material such as flexible vinyl chloride resin. As best shown in FIG. 5, an inner surface of the attachment tube section 25, as well as the inner surface of the main tube section 24, is provided with grooves 28, 28 at opposite sides thereof, wherein the grooves 28, 28 run along a top-bottom direction (along the axial direction of the attachment tube section 25) to form thin portions 29, 29 along the top-bottom direction. Each of these grooves 28, 28 and also the thin portions 29, 29 covers the entire length of the attachment tube section 25 from the upper end to the lower end along the axial direction thereof. The grooves 28, 28 and the thin portions 29, 29 are located at the same peripheral positions as the grooves 26, 26 and the thin portions 27, 27, of the main tube section 24 are respectively located.

Although both the main tube section 24 and the attachment tube section 25 are made of the flexible plastic materials in this embodiment, any material can be adopted as long as the attachment tube section 25 is finally brought to the elastic deflection by decompressing the inside area of the cup. For example, it is possible to make the main tube section 24 out of a flexible plastic material such as flexible vinyl chloride resin, but make the attachment tube section 25 out of a rigid plastic material, such as rigid vinyl chloride resin or ABS resin.

Now, the operation of the suction cup will be described in detail.

First of all, the hose 7, which is connected with the vacuum source 6 at one end, is fitted on and connected with the connecting aperture section 4 of the suction cup at the other end. At this stage, the valve member 18 in the suction release section 5 has been urged against the outer end wall 17 by the spring 20, and the outer end aperture 17*a* has been sealed with the valve member 18.

Then an end portion of the tube section 3 of the suction cup, i.e. the lower end of the attachment tube section 25 in FIG. 2, is put on a part of the body where fat reduction is desired, e.g. a belly part, and the vacuum source 6 is switched on to draw the air from the inside area of the cup and decompress the inside area to a predetermined negative pressure. At this stage, the valve member 12 of the non-return valve 9 within the connecting aperture section 4 is pushed up as the air is drawn and abuts against bottom faces of the stopper projections 13. The air inside the cup is drawn via opening parts 30 shown in FIG. 3, wherein each opening part 30 is formed on a gap between the inner surface of the air path 10 and an outer peripheral face of the valve member 12 at a part where no stopper projection 13 is located. The compression spring 20 is designed to have a sufficient urging force to prevent the valve member 18 of the suction release section 5 from being pushed inward by external pressure when the air is drawn from the inside area of the cup and the inside area is decompressed to the predetermined negative pressure.

As the tube section 3 is provided with the thin portions 27, 27, 29, 29 at opposite sides thereof and the local strength is lower at those thin portions than it is at the other parts of the tube section 3, the tube section 3 bends easily at those thin portions 27, 27, 29, 29 and elastically deflects into a flat shape as shown in FIG. 6 when the end portion of the tube section 3 is attached to the part of the body where fat reduction is desired and the inside area of the cup is decompressed. This means that the tube section 3 bends at the thin portions 27, 27, 29, 29 and deflects elastically into the flat shape at the same time as the part 31 of the body, where fat reduction is desired and which is defined by the end portion of the tube section 3, is sucked in by the tube section 3 as shown in FIG. 7A. This elastic deflection causes the body part 31 sucked into the end portion of the tube section 3 to be pressed by the end portion from opposite sides thereof (in the directions A) as shown in FIG. 7B, instead of being sucked simply in one direction. Though it is depicted in FIGS. 7A and 7B as if the pressing process from the sides took place following the suck-in process to help understanding, the pressing process and the suck-in process actually take place concurrently.

The hose 7 may be removed from the connecting aperture section 4 of the cup body 2 after the inside area of the cup is decompressed to the predetermined negative pressure and the part of the body reaches to the state of being sucked into the inner area of the cup and pressed from opposite sides thereof concurrently. Following the removal of the hose 7, the valve member 12 of the non-return valve 9 seals an upper end of the aperture 11 in response to pressure difference between the inside area and the outside of the cup so as to disconnect the inside area of the cup from the outside and maintain the decompressed state therein, i.e. the state at which the body part is sucked in by the cup and pressed from opposite sides concurrently. The suck-in state of the part of the body is terminated after a predetermined time period by pressing the handle portion 19 of the suction release section 5 inward (toward left in FIG. 2) against the urging force of the compression spring 20 and allowing the air to flow into the inside area of the cup via a gap between the handle portion 19 and the outer end aperture 17*a*. The decompressed state inside the cup is released by this inflow and so is the suck-in state of the part of the body.

Though each set of the thin portions 27 and 29 covers the entire length of the tube section 3 from the upper end to the lower end thereof in this embodiment, it is not essential that each set of the thin portions 27 and 29 covers the entire length. Instead, each set of the thin portions 27 and 29 may cover only a partial length of the tube section 3, as long as at least the end portion of the tube section 3 remains capable of deflecting elastically into the flat shape and pressing the sucked-in part of the body from opposite sides when the inside area of the cup is decompressed to the predetermined negative pressure. For example, each set may cover an end part (the attachment tube section 25 in the above embodiment) only, the entire length but for the end part, or some arbitrary parts along the entire length but for the end part.

Now, the second embodiment of the present invention will be described. The suction cup of the second embodiment is basically of the same structure as that of the first embodiment, but a difference lies in that a twisting force is realized in the second embodiment in addition to the simple pressing force from opposite sides which has been realized in the first embodiment.

Figure 8A:
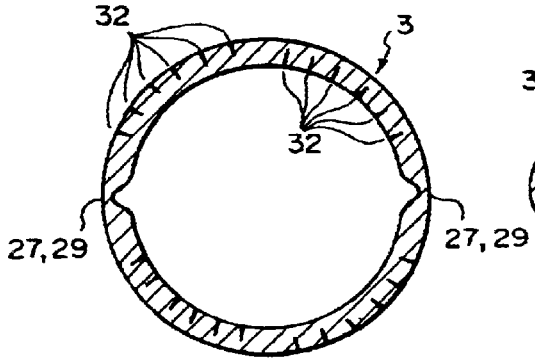
FIGS. 8A and 8B are cross-sectional views of the suction cup for body fat reduction in accordance with the second embodiment of the present invention.
Figure 8B:
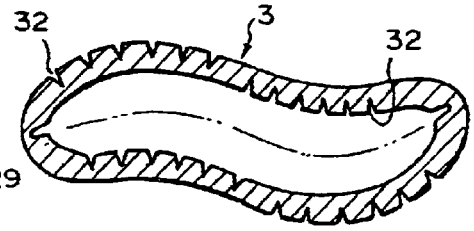

In the second embodiment, the tube section 3 is provided with a plurality of cuts 32 on inner and outer peripheral surfaces thereof as shown in FIG. 8A, wherein one of the cuts 32 belonging to one series is provided on the opposite peripheral surface with respect to the peripheral surface where another cut 32 belonging to an adjacent series is provided, and each series of cuts covers a peripheral dimension of about 45°. The cuts 32 open as the inside area of the cup is decompressed, and enable the tube section 3 to deflect elastically into a flat and winding shape, substantially into an S-like shape as shown in FIG. 8B, instead of deflecting elastically into the simple flat shape. With this type of deflection, even more excellent fat reduction is expected as the twisting force is applied to the part of the body sucked in by the cup in addition to the pressing force from opposite sides.

Each of the cuts 32, as well as each set of the grooves 26 and 28, covers the entire length of the tube section 3 from the upper end to the lower end thereof in this embodiment. However, each cut 32, as well as each set of the grooves 26 and 28, may cover only an arbitrary portion of the tube section 3 (e.g. only the attachment tube section 25 in the embodiment above) as a matter of course, as long as the tube section 3 remains capable of deflecting elastically into the flat and winding shape when the inside area of the cup is decompressed.

The elastic deflection into the flat shape may be realized with various methods other than the method of providing the thin portions. As an extreme example, the use of the deflectable material for the tube section 3 may be sufficient in itself if the formed tube section 3 is capable of deflecting elastically into the flat shape under the decompression. The elastic deflection into the flat and winding shape may also be realized with various methods other than the method of providing the cuts.

The non-return valve 9 and the suction release section 5 are optional and, if adopted, may be of various structures other than those structures shown in the accompanying drawings.

Though the vacuum pump is used for decompressing the inside area of the cup in the embodiments above, the decompression may be realized with other methods. For example, the method of bringing an appropriate amount of alcohol to combustion inside the cup to reduce the air or oxygen therein may be adopted as the decompression method.

What is claimed is:

1. A suction cup for body fat reduction to be attached tightly at an open end portion thereof to a part of the body where fat reduction is desired to suck in the part of the body as an inside area of the suction cup is decompressed, wherein said suction cup includes a cup body and a tube section which extends downward from said cup body, said tube section having a cylindrical shape which is rectangular in cross-section when taken along the long axis of said tube section, said tube section having a height taken along the long axis of said tube section so that at least the open end portion of said tube section deflects elastically into a flat shape to press the sucked-in part of the body from opposite sides thereof into a flat shape as the inside area is compressed.

2. A suction cup for body fat reduction as defined in claim 1 wherein the tube section is made of a deflectable material and has thin portions at opposite sides thereof.

3. A suction cup for body fat reduction as defined in claim 1 wherein said cup body is provided with a connecting aperture section which is capable of being fixed to and detached from vacuum means, the aperture section including a non-return valve therein which prevents air-flow into the suction cup after the vacuum means is detached.

4. A suction cup for body fat reduction to be attached tightly at an open end portion thereof to a part of the body where fat reduction is desired to suck in the part of the body as an inside area of the suction is decompressed, wherein said suction cup includes a tube section which is constructed with a plurality of cuts on both the inner and outer peripheral surface of the open end portion thereof such that said open end portion deflects elastically into a flat and winding shape to twist the sucked-in part of the body while pressing the same sucked-in part into a flat and winding shape from opposite sides thereof as the inside area is decompressed.

5. A suction cup for body fat reduction as defined in claim 4 wherein the tube section is made of a deflectable material and has thin portions at opposite sides thereof.

6. A suction cup for body fat reduction as defined in claim 4 wherein said suction cup is provided at an end opposite to said open end portion with a connecting aperture section which is capable of being fixed to and detached from vacuum means, the aperture section including a non-return valve therein which prevents air-flow into the suction cup after the vacuum means is detached.

* * * * *